United States Patent [19]

Reist

[11] Patent Number: 4,905,981

[45] Date of Patent: Mar. 6, 1990

[54] APPARATUS FOR CHANGING THE POSITION OF PRINTED PRODUCTS ARRANGED IN AN IMBRICATED FORMATION

[75] Inventor: Walter Reist, Hinwil, Switzerland

[73] Assignee: Ferag AG, Hinwil, Switzerland

[21] Appl. No.: 321,792

[22] Filed: Mar. 10, 1989

[30] Foreign Application Priority Data

Mar. 14, 1988 [CH] Switzerland ..... 00959/88

[51] Int. Cl.[4] ..... B65H 9/10

[52] U.S. Cl. ..... 271/233; 271/271; 271/151; 271/202; 271/270

[58] Field of Search ..... 271/271, 149–151, 271/198, 202, 203, 182, 216, 233, 270; 198/459, 462

[56] References Cited

U.S. PATENT DOCUMENTS

| | | | |
|---|---|---|---|
| 3,964,598 | 6/1976 | Alsop | 271/216 |
| 4,072,228 | 2/1978 | Honegger et al. . | |
| 4,534,550 | 8/1985 | Reist | 271/270 |

FOREIGN PATENT DOCUMENTS 631410 8/1982 Switzerland .

*Primary Examiner*—H. Grant Skaggs

*Attorney, Agent, or Firm*—Bell, Seltzer, Park and Gibson

[57] ABSTRACT

The apparatus for changing the position of printed products arranged in an imbricated formation comprises two band conveyors arranged in tandem as viewed in the conveying direction, and a position-change device arranged in the end region of the conveying-active path of the first of the two band conveyors. The disc-shaped supporting elements of the position-change device and each having a cam are seated at shafts, the rotational axes of which extend substantially perpendicular to the plane of conveyance of the first of the two band conveyors. The shafts are driveable synchronously and in opposite directions. The trailing or upstream edges of the printed products come to bear upon the disc-shaped supporting elements and the cams upwardly project in the region of the imbricated formation. During each revolution of the disc-shaped supporting elements the cams bear against the trailing or upstream edge of a printed product, entrain the printed product in the conveying direction and deliver the printed product to the second of the two band conveyors. The position of the printed products is changed in the imbricated formation such that the spacing or pitch between the trailing or upstream edges of the printed products outfed by the second of the two band or belt conveyors is constant.

28 Claims, 6 Drawing Sheets

APPARATUS FOR CHANGING THE POSITION OF PRINTED PRODUCTS ARRANGED IN AN IMBRICATED FORMATION

BACKGROUND OF THE INVENTION

The present invention broadly relates to infeeding and outfeeding of substantially flat products arranged in an imbricated formation and, more specifically pertains to a new and improved apparatus for changing the position of printed products in an imbricated formation. The present invention also relates to the use of the new and improved apparatus in order to form modified imbricated formations.

Generally speaking, the apparatus of the present invention is of the type comprising a conveying device defining a plane of conveyance for the imbricated formation and at least one position-change or positioning device provided with revolvingly driven entrainment members which pass through at least one closed revolving path. The rotational speed of the at least one position-change or positioning device is greater than the predetermined conveying speed of the conveying device and the entrainment members can be brought to act upon the trailing or upstream edges of the printed products as viewed in the predetermined conveying direction.

Such an apparatus for evening or making uniform an imbricated stream of printed products is known, for example, from Swiss Patent No. 631,410, published Aug. 13, 1982. The apparatus disclosed therein comprises a band or belt conveyor in order to supply the printed products arranged in an imbricated formation to a flow-downstream located position-change or positioning device. An outfeed device constructed as a band or belt conveyor is arranged downstream of the position-change or positioning device in order to discharge the evened imbricated formation. The position-change or positioning device comprises entrainment members arranged in an evenly spaced relationship to one another at a revolvingly driven traction member. The entrainment members are revolvingly driven at a higher speed than the conveying speed of the imbricated formation. At the start and at the end of the conveying-active path of the position-change or positioning device, the traction member is guided around rotatably mounted deflection rolls each rotating about a horizontal axis.

The revolving path of the entrainment members thus extends in a plane extending in the conveying direction of the imbricated formation and perpendicular to the plane of conveyance of the imbricated formation. The entrainment members underrun the infed imbricated formation and engage the respective trailing edges of the printed products. The spacing or pitch of the printed products supplied to the outfeed device by the entrainment members of the position-change or positioning device corresponds to the spacing or distance between the entrainment members. This known apparatus is complicated in construction and design and requires a considerable overall length. A change of the spacing or pitch between the trailing product edges in the evened imbrication formation is not possible.

A further apparatus for making uniform or evening an imbricated stream of printed products is known, for example, from Swiss Patent No. 610,276 and its cognate U.S. Pat. No. 4,072,228, granted Feb. 7, 1978. This known apparatus comprises a band or belt conveyor which conveys the imbricated formation to a flow-downstream arranged position-change or positioning device which, after accomplishing the evening of the spacing or pitch between the printed products, delivers the imbricated formation to an outfeed device for further conveyance. The position-change or positioning device comprises a number of revolving entrainment members which are in a drag connection with one another and guided in an endless closed channel. The upper extended conveying-active branch of the endless closed channel is located in the imaginary extended plane of conveyance defined by the band or belt conveyor. At the start and at the end of the conveying-active path of the position-change or positioning device there are provided a thrust drive and a traction drive which are synchronized with the band or belt conveyor and the outfeed device, respectively, and which act directly on the entrainment members.

In the starting region of the conveying-active path, each entrainment member bears upon the trailing or upstream edge of a printed product and entrains such printed product in the conveying direction. In the course of the conveying-active path the entrainment members are either pushed by the trailing or upstream entrainment members or pulled by the leading or downstream entrainment members because of the drag connection thereof. At the end of the conveying-active path the entrainment members deliver the printed products, due to the synchronized traction drive, in fixed-cycle fashion or rhythm to the outfeed device or conveyor, so that the spacing or pitch between the printed products in the outfed imbricated formation is constant. By virtue of the drag connection which permits relative movements between adjacent entrainment members, this apparatus can also compensate for phase shifts occurring between the take-over cycle and the delivery cycle. However, this known apparatus is complicated in construction and design and the space requirements therefor are considerable.

SUMMARY OF THE INVENTION

Therefore, with the foregoing in mind it is a primary object of the present invention to provide a new and improved construction of an apparatus for changing the position of printed products arranged in an imbricated formation, and which does not exhibit the aforementioned drawbacks and shortcomings of the prior art constructions.

Another and more specific object of the present invention aims at providing a new and improved apparatus for changing the position of printed products arranged in an imbricated formation and which is extremely simple in construction and design and requires a minimum of space. Furthermore, the range of use or application of the apparatus constructed according to the invention can be extended in that imbricated formations can be processed in which two or more superimposed printed products are imbricatingly arranged upon neighboring superimposed printed products.

Yet a further significant object of the present invention aims at providing a new and improved construction of an apparatus of the type described which is extremely economical to manufacture, highly reliable in operation, not readily subject to malfunction and requires a minimum of maintenance and servicing.

Now in order to implement these and still further objects of the invention, which will become more readily apparent as the description proceeds, the apparatus of the present invention, among other things, is manifested by the features that at least two revolving paths are provided in the plane of conveyance and that at least one entrainment member in one of the two revolving paths revolves synchronously with at least one entrainment member in the other of the two revolving paths. The two revolving paths have portions in which the at least two entrainment members can be brought to act upon the printed products, and these portions of the two revolving paths are arranged in a spaced relationship to one another in a direction which is substantially perpendicular to the predetermined conveying direction of the conveying device.

Two revolving paths are thus arranged substantially in the conveying plane. At least one entrainment member revolves along one of the two revolving paths synchronously with at least one entrainment member revolving along the other of the two revolving paths. In this manner, at least two entrainment members come to act in each case upon the trailing edge of the same or common printed product, with the result that printed products inclinedly arranged in the imbricated formation are aligned such that their trailing edges extend substantially perpendicular to the predetermined conveying direction, and that printed products during the change of position thereof do not assume an inclined or unaligned position.

By adapting the rotational speed of the entrainment members to the conveying speed of the conveying device and thus to the spacing or pitch between the printed products in the infed imbricated formation, the spacing or pitch between the printed products is evened or made uniform and the printed products are conveyed away in accordance with a phase relationship predetermined or governed by further processing requirements. Furthermore, it is thus possible that the entrainment members only act upon every second printed product and push or shift such product onto the respective leading or preceding or downstream printed product. However, it is also possible that in an imbricated formation in which in each case two superimposed printed products imbricatingly bear upon neighboring printed products, the entrainment members only act upon one of the two superimposed printed products, so that an imbricated formation is formed in which again only one printed product imbricatingly bears upon the neighboring or adjacent printed product.

The revolving paths of the entrainment members are provided essentially in the plane of conveyance. By virtue of the form or configuration of such revolving paths it is rendered possible that, at a constant rotational speed of the entrainment members, the speed of the entrainment members with respect to the conveying direction of the imbricated formation is no longer constant. As a result, it is possible in a simple and space-saving construction of the position-change or positional device to retain or hold back in a waiting position the entrainment members in the starting region of the conveying-active path, until the next following printed product of the infed imbricated formation reaches the region of the conveying-active path. Furthermore, the spacing or pitch of the trailing edges of the printed products changed in their respective positions is now adjustable by modifying the form or configuration of the revolving path and changing the rotational speed.

In a particularly simple and advantageous embodiment of the apparatus constructed according to the invention there are provided two supporting members which are arranged in a spaced relationship to one another in a direction substantially at right angles to the conveying direction and are rotatably and synchronously driveable about respective axes extending essentially at right angles to the plane of conveyance. At each supporting member there is eccentrically secured at least one entrainment member.

A particularly space-saving apparatus can be achieved in that the conveying device comprises at least one endless conveyor having two revolvingly driven conveying members which extend parallel to each other and are arranged in spaced relationship to one another. The position-change or positioning device is arranged between these conveying members.

The at least one position-change or positioning device can be arranged in the end region of the conveying-active path of the endless conveyor of the conveying device, and an outfeed device can be adjacently arranged downstream of the endless conveyor. This outfeed device advantageously has a conveying speed which is variable with respect to the predetermined conveying speed of the endless conveyor of the conveying device. It is thus possible to form imbricated formations in which the spacing or pitch between the printed products is larger or smaller than the mean or average spacing or pitch between the printed products in the arriving imbricated formation.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Describing now the drawings, it is to be understood that to simplify the showing thereof, only enough of the construction of the exemplary embodiments of apparatus for changing the position of printed products arranged in an imbricated formation has been illustrated therein as is needed to enable one skilled in the art to readily understand the underlying principles and concepts of this invention. Turning attention now specifically to FIGS. 1 and 2 of the drawings, the apparatus illustrated therein by way of example and not limitation will be seen to comprise two band or belt conveyors 12 and 14 arranged in tandem or succession as viewed in the predetermined conveying direction F at a support or stand or frame 10. On these band or belt conveyors 12 and 14 there is arranged an imbricated formation S of printed products 16, for instance newspapers, magazines or parts thereof, in which imbricated formation, as viewed in the conveying direction F, each printed product 16 bears upon the leading or preceding or downstream printed product 16.

Figure 2:
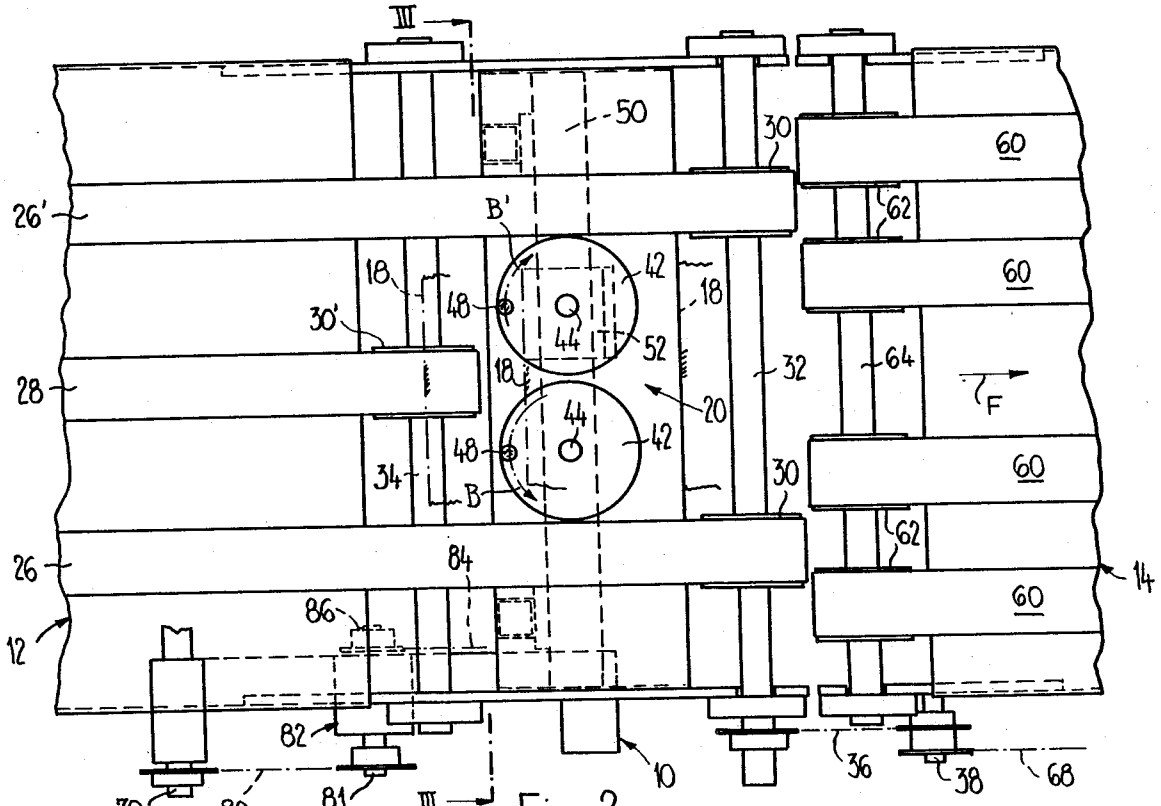
FIG. 2 schematically shows in a fragmentary top plan view, on an enlarged scale and in a simplified illustration, a part of the apparatus according to FIG. 1.

In FIG. 2 only the trailing or upstream edges 18 of three printed products 16 of the imbricated formation S are indicated in dash-dotted lines in the end region of the conveying-active path of the first band or belt conveyor 12. In this end region there is provided a position-change or positioning device 20. A retaining or hold-back device 22 is arranged upstream of the position-change or positioning device 20 and above the first band or belt conveyor 12. Downstream of this position-change or positioning device 20 there is provided a braking or retarding device 24 arranged above and coacting with the second band or belt conveyor 14. The retaining or hold-back device 22 and the braking or retarding device 24 are not particularly shown in FIG. 2.

The first band or belt conveyor 12, of which the starting region is not particularly shown in the drawings, comprises three endless bands or belts 26, 26' and 28 which revolve parallel to one another and are arranged in a spaced relationship to one another in a direction substantially at right angles to the conveying direction F. The two outer or external endless bands or belts 26 and 26' are guided around deflection rolls or rollers 30 located at the end of the conveying-active path. These deflection rolls or rollers 30 are seated at a shaft 32 in a manner such as to be non-rotatable relative hereto. The shaft 32 is rotatably mounted at the support or stand or frame 10. The intermediate or central endless band or belt 28 is guided around a deflection roll or roller 30' which is seated on a shaft 34 likewise mounted at the support or stand 10 and located upstream of the shaft 32 as viewed in the conveying direction F. This shaft 32 is operatively connected by means of a chain drive 36 indicated by dash-dotted lines to a drive or driving shaft 38 mounted at the support or stand 10. This drive or driving shaft 38, in turn, is driven via a further chain drive 40, indicated only in FIG. 1, in the direction of the arrow A by any suitable drive motor which thus has not been particularly shown in the drawings. The intermediate or central endless band or belt 28 is revolvingly driven at the start of the conveying-active path in known manner synchronously with the outer or external endless bands or belts 26 and 26'.

As can be clearly derived from FIG. 2, the position-change or positioning device 20 is arranged between the two outer or external endless bands or belts 26 and 26' and the two shafts 32 and 34. This position-change or positioning device 20 comprises two disc-shaped or discoidal supporting or carrier members 42 which are arranged in spaced relationship to one another in a direction substantially perpendicular to the conveying direction F. These disc-shaped supporting or carrier members 42 are seated at respective shafts 44 in a manner such as to be non-rotatable relative thereto. The rotational axes 46 of these shafts 44 extend at right angles to the plane of conveyance of the band or belt conveyor 12. At each supporting or carrier member 42 there is eccentrically arranged a substantially mushroom-shaped cam 48 or equivalent structure which projects or extends with its free upper end into the region of the imbricated formation S. The opposite directions of rotation of the two supporting or carrier members 42 are designated with the reference characters B and B'. The two shafts 44 are rotatably mounted at a traverse or crosspiece 50 of the support or stand 10 and are in operative connection with a bevel gearing or gear unit 52 or the like which is only schematically indicated in the drawings. Such bevel gearing or gear unit 52 is connected via a chain drive 54, indicated in FIG. 1 in dash-dotted lines, with a rotary shaft 56 mounted at the support or stand 10. This rotary shaft 56 is in operative connection with the drive or driving shaft 38 via a further chain drive 58.

Figure 1:
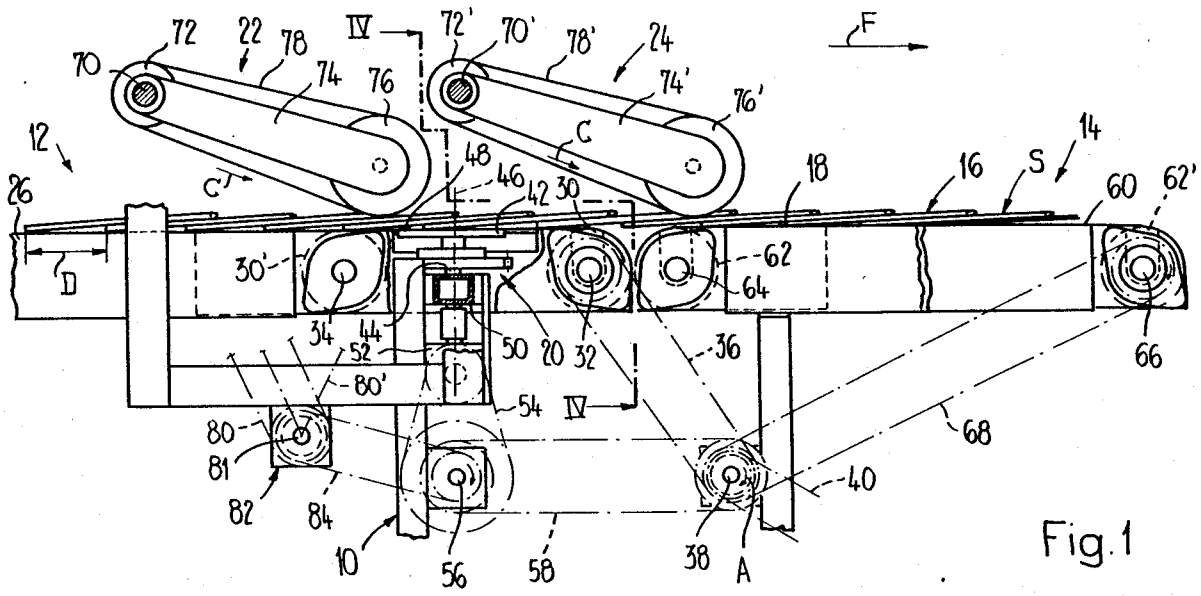
FIG. 1 schematically shows in a side view a preferred exemplary embodiment of apparatus for changing the position of printed products arranged in an imbricated formation and constructed according to the invention.

Four endless bands or belts 60 of the second band or belt conveyor 14 are guided at the start of the conveying-active path around deflection rolls or rollers 62. These deflection rolls or rollers 62 are seated on a further shaft 64 mounted at the support or stand 10. The start of the conveying-active path of the second band or belt conveyor 14 directly adjoins the end of the conveying-active path of the first band or belt conveyor 12. At the end of the conveying-active path, the four endless bands or belts 60 are likewise guided around deflecting rolls or rollers 62' as shown in FIG. 1. These deflecting rolls or rollers 62' are non-rotatably seated at a further shaft 66 in a manner such as to be non-rotatable relative thereto. This shaft 66 is mounted at the support or stand 10 and is operatively connected with the drive or driving shaft 38 by means of a schematically indicated chain drive 68.

The retaining or hold-back device 22 and the braking or retarding device 24 are of identical construction and design and comprise respective rotary shafts 70 and 70' rotatably mounted at the support or stand 10. Respective rolls or rollers 72 and 72' are seated at the rotary shafts 70 and 70' in a manner such as to be non-rotatable relative thereto, and at these rolls or rollers 72 and 72' there are pivotably mounted respective weight or loading levers 74 and 74'. At the free ends of these weight levers 74 and 74' there are rotatably mounted respective deflection rolls or rollers 76 and 76'. Respective endless bands or belts 78 and 78' are guided around the rolls or rollers 72 and 72' and the deflection rolls or rollers 76 and 76'. The endless band or belt 78 of the retaining or hold-back device 22 bears upon the imbricated formation S in the end region of the intermediate or central endless band or belt 28 of the first band or belt conveyor 12, while the endless band or belt 78' of the braking or retarding device 24 bears upon the imbricated formation S in the starting region of the conveying-active path of the second band or belt conveyor 14.

The rotary shafts 70 and 70' are connected with an output or drive shaft 81 of a reverse or reversing gearing or gear unit 82 by means of respective chain drives 80 and 80' which are only schematically and fragmentarily indicated in FIG. 1. An input or drive shaft 83 of the reverse or reversing gearing or gear unit 82 is in operative connection with the rotary shaft 56 by means of a further chain drive 84. The two endless bands or belts 78 and 78' are driven in the direction of the arrow C at a rotational speed which corresponds to the conveying speed of the two band or belt conveyors 12 and 14.

Figure 3:
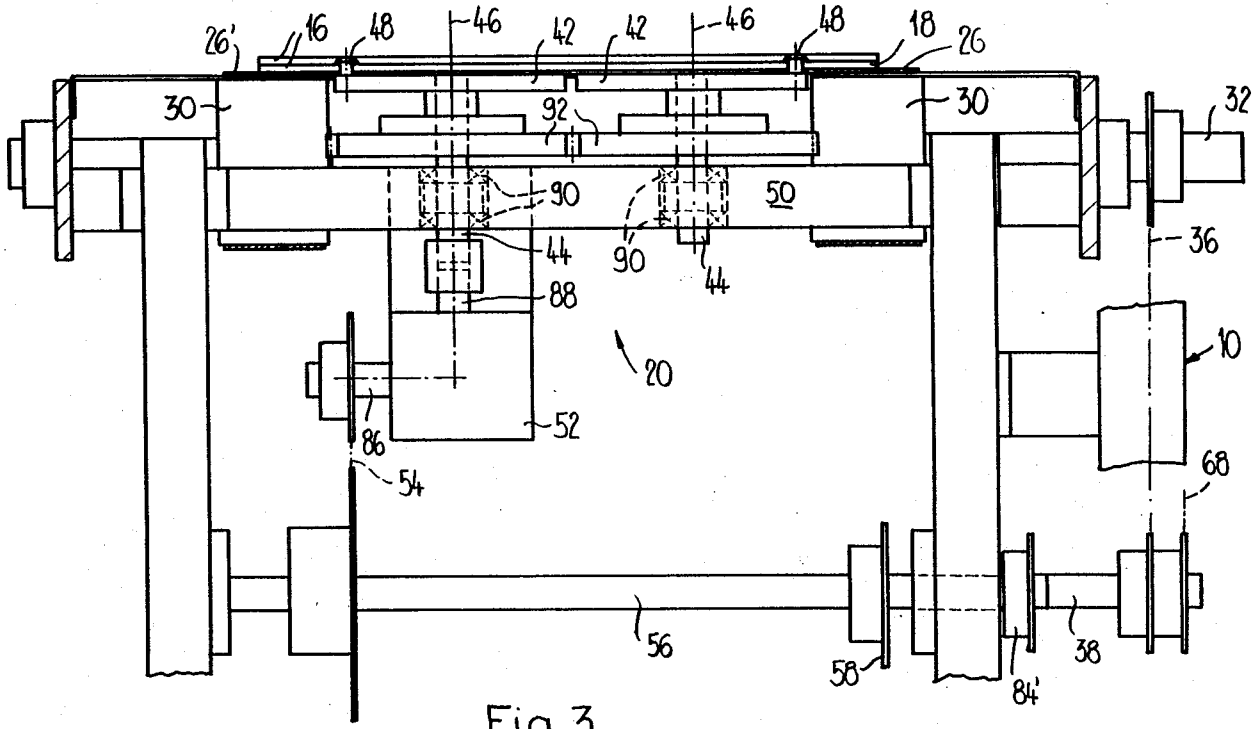
FIG. 3 schematically shows a cross-section taken substantially along the line III—III in FIG. 2.

FIG. 3 shows a sectional view substantially taken along the line III—III of FIG. 2, and in this FIG. 3 the position-change or positioning device 20 is particularly clearly depicted. The endless bands or belts 26 and 26' shown in section are guided around the deflection rolls or rollers 30 which are seated at the shaft 32 mounted at the support or stand or frame 10. This shaft 32 is operatively connected to the drive or driving shaft 38 by means of the chain drive 36 which likewise drives the second band or belt conveyor 14 (cf. FIG. 1) by means of the chain drive 68 which is only fragmentarily illustrated and indicated by dash-dotted lines in FIG. 3. The rotary shaft 56 likewise mounted at the support or stand 10 is driven by the drive or driving shaft 38 via the chain drive 58, and acts, in turn, upon the reverse or reversing gearing 82 (cf. FIG. 1) by means of the chain drive 84, of which only the chain wheel 84' seated on the rotary shaft 56 is shown in FIG. 3.

The rotary shaft 56 is operatively connected by means of the chain drive 54 to the drive or driving shaft 86 of the bevel gearing or gear unit 52 secured at the traverse 50. The output or drive shaft 88 of the bevel gearing 52 is in alignment with the shaft 44 of one of the two disc-shaped supporting or carrier members 42 and is coupled with this shaft 44 in a manner such as to be non-rotatable relative thereto. The shafts 44 of the two supporting or carrier members 42 are rotatably mounted at the traverse 50 by means of ball bearings 90 and supported in the direction of the respective rotational axis 46. At the two shafts 44 there are seated respective toothed or gear wheels 92 which mesh with one another and possess the same diameter, with the result that the two supporting or carrier members 42 are driven in opposite directions, but with the same speed or number of revolutions. The two cams or cam members 48 arranged at their respective supporting or carrier members 42 are shown in FIG. 3 in a position in which they lie together with their respective rotational axis 46 in a straight line which extends substantially perpendicular to the conveying direction F. Both cams 48 act upon the trailing or upstream edge 18 of the underlying one of the two superimposed printed products 16 shown in FIG. 3.

Figure 4:
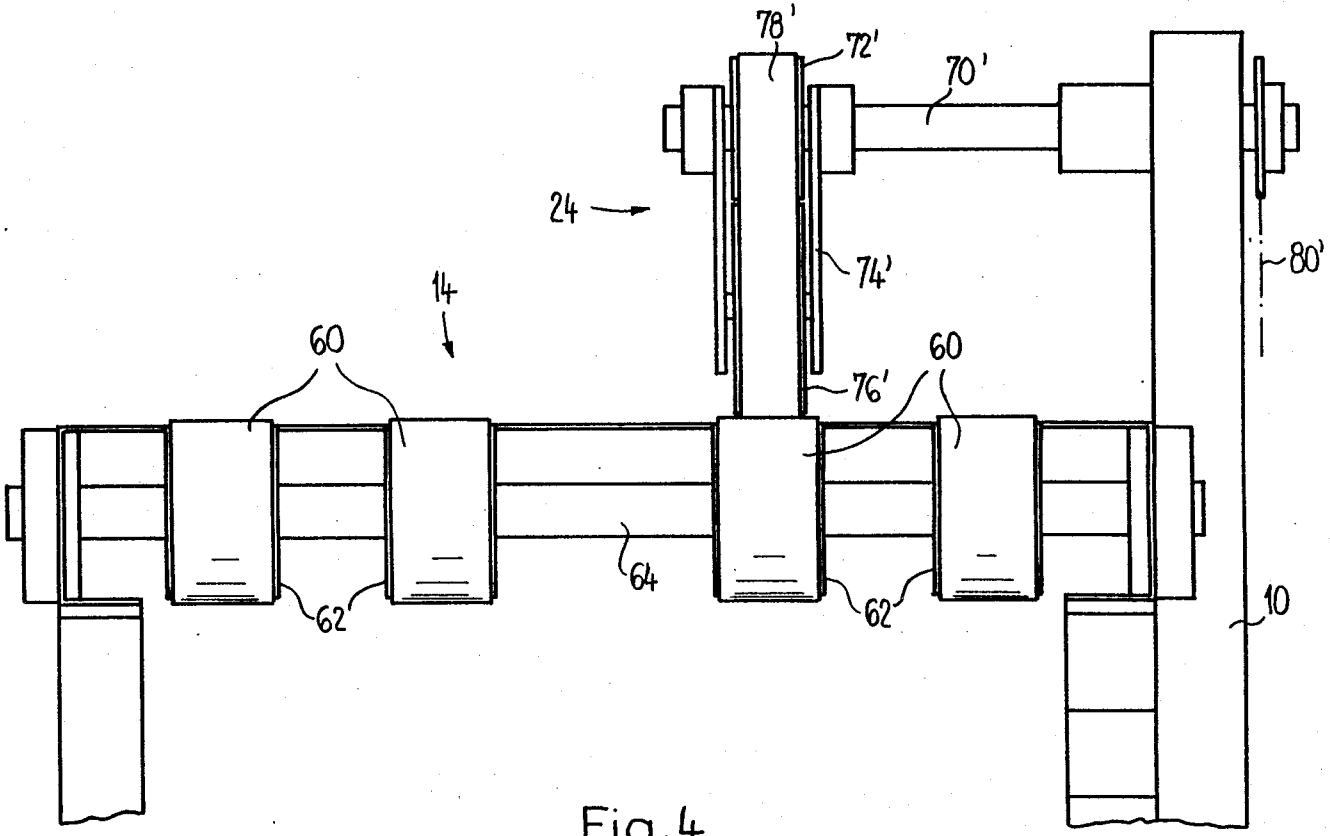
FIG. 4 schematically shows a sectional view taken substantially along the line IV—IV in FIG. 1.

FIG. 4 shows the second band or belt conveyor 14 with its four revolvingly driven endless bands or belts 60 which extend substantially parallel to one another and are guided around the deflection rolls or rollers 62 at the start of the conveying-active path. These deflection rolls or rollers 62 are seated on the shaft 64 which is rotatably mounted at the support or stand 10. The rotary shaft 70' of the braking or retarding device 24 likewise rotatably mounted at the support or stand 10 is operatively connected to the reverse or reversing gearing 82 by means of the chain drive 80' (cf. FIG. 1). The roll 72' is seated at the rotary shaft 70' in a manner such as to be non-rotatable relative thereto. The endless band or belt 78' extends around this roll or roller 72' and is likewise guided around the deflection roll or roller 76' rotatably mounted at the free end of the weight or loading lever 74'. The endless band or belt 78' is in alignment with the second endless band or belt 60 as viewed from the right-hand side of the illustration in FIG. 4.

Having now had the benefit of the foregoing discussion of the exemplary embodiment illustrated in FIGS. 1 through 4, the mode of operation of the apparatus for changing the position of printed products in an imbricated formation is hereinafter described and is as follows:

The two band or belt conveyors 12 and 14 are driven at the same conveying speed in the predetermined conveying direction F. This conveying speed corresponds to the rotational speed of the two endless bands or belts 78 and 78' of the retaining or hold-back device 22 and the braking or retarding device 24 in the direction of the arrow C. In the imbricated formation S, the product spacing or pitch designated with the reference character D and located between the trailing or upstream edges 18 of the printed products 16 supplied or infed to the position-change or positioning device 20 is uneven or non-uniform. The rotational speed of the cams or cam members 48 secured at the supporting or carrier members 42 is adapted to the infed imbricated formation S in such a manner, that the two cams 48 during each revolution about the rotational axes 46 bear upon the trailing or upstream edge 18 of a respective printed product 16 and push or shift this printed product 16 in the conveying direction F o to the leading or preceding or downstream printed product 16, until the cams 48 run off or move away from the trailing or upstream edge 18.

The trailing or upstream printed product 16, which is in contact with the printed product 16 pushed forward by the cams 48 in the conveying direction F, is further conveyed at essentially constant speed by the retaining or hold-back device 22 and the band or belt conveyor 12 and secured against entrainment by friction. The printed product 16 released by the cams 48 reaches or enters the operating region of the braking or retarding device 24 prior to the cams 48 coming to act at the trailing or upstream edge 18 of the next following printed product 16. The result is that the printed product 16 accelerated by the cams 48 is braked and further conveyed or transported at the conveying speed of the second band or belt conveyor 14 without being affected or influenced by the next following or trailing printed product 16. Since the speed of the disc-shaped supporting or carrier members 42 is synchronized with the conveying speed of the two band or belt conveyors 12 and 14, the spacing or pitch between the trailing or upstream edges 18 of the printed products 16 outfed by the band or belt conveyor 14 is constant.

The apparatus according to FIG. 1 is shown in FIGS. 5*a* through 5*d* in a very simplified illustration. The two band or belt conveyors 12 and 14 arranged in succession or in tandem convey or transport in the conveying direction F the printed products 16 arranged thereupon in imbricated formation. The position-change or positioning device 20 provided in the end region of the conveying-active path of the first band or belt conveyor 12 is shown with one rotatable supporting or carrier member 42 which is rotatable about the rotational axis 46 and contains the associated cam 48. The retaining or hold-back device 22 and the braking or retarding device 24 are symbolically represented by means of respective pressure or contact rolls 94 and 94' which also may be replaced by pressure bands.

Figure 5A:
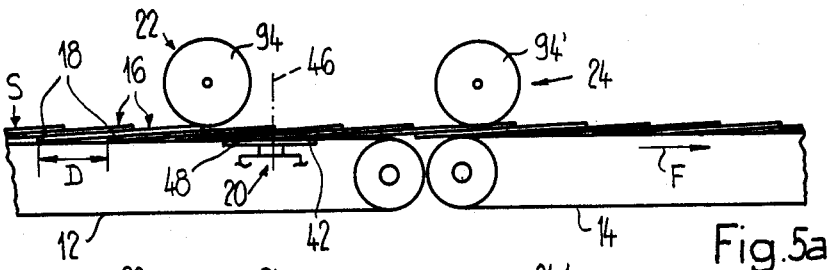
FIGS. 5*a* through 5*d* schematically show in simplified manner the apparatus according to FIG. 1 in different modes of operation.
Figure 5B:
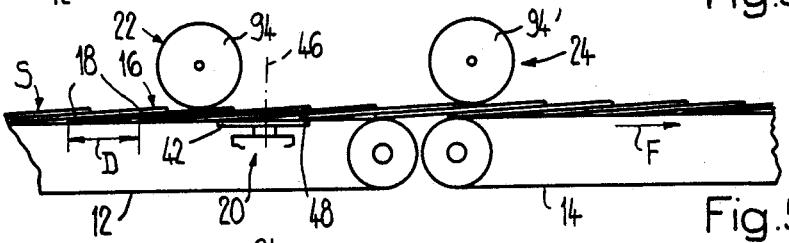

In FIGS. 5*a* and 5*b* the spacing or pitch between the trailing edges of the printed products 16 supplied to the position-change or positioning device 20 is designated with the reference character D. Such spacing or pitch D undergoes deviations which are compensated for by the position-change or positioning device 20. The speed of the supporting or carrier member 42 is synchronized with the conveying speed of the two band or belt conveyors 12 and 14 as well as to a mean or average spacing or pitch D between the trailing or upstream edges 18 of the infed printed products 16, such that the cams 48 come to bear upon the trailing edge of a respective printed product 16 during each revolution.

In FIG. 5*a* the cam 48 is located at the rear or upstream end position thereof. In FIG. 5*b* the cam 48 is located at the forward or downstream end position thereof. Upon rotation about the rotational axis 46, the cam 48 catches up with the trailing edge 18 sliding on the supporting or carrier member 42 and pushes or shifts the thus engaged printed product 16 in the conveying direction F and therefore in the downstream direction with respect to the neighboring printed products 16. During each forward-shifting operation of a printed product 16, the two neighboring printed products 16 of the latter are retained or held by the pressure rolls 94 and 94' against positional shifting. The spacing or pitch between the trailing edges 18 of the printed products 16 outfed by the second band or belt conveyor 14 is thus constant.

Figure 5C:
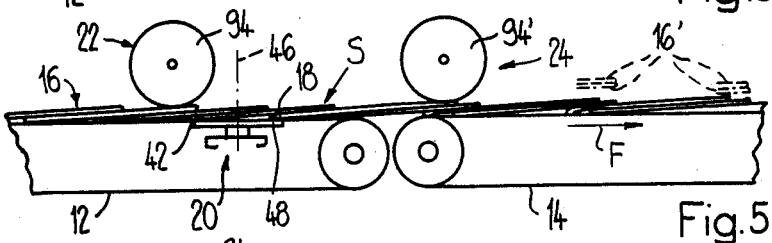

With the apparatus depicted in FIG. 5*c*, it is possible that from an imbricated formation S in which each printed product 16 imbricatingly bears upon the respective leading or downstream printed product 16, there can be formed an imbricated formation S in which pairwise two superimposed printed products 16 imbricatingly bear upon the leading or downstream pair of printed products 16. For this purpose, the supporting member 42 is driven with half the number of revolutions compared to the mode of operation according to FIGS. 5*a* and 5*b*, so that the cam 48 comes to bear against the trailing or upstream edge 18 of every second printed product 16. In this manner, every second printed product 16 is pushed or shifted in the conveying direction F on to the respective leading or preceding printed product 16. As illustrated in full lines in FIG. 5*c*, two of the printed products 16 outfed by the band or belt conveyor 14 lie almost coincidentally or squared-up and superimposed upon one another. By enlarging the distance or spacing between the rotational axis 46 and the cam 48, the engaged printed product 16 is pushed or shifted coincidentally or so as to be accurately squared-up onto the leading or preceding printed product 16 as shown in dash-dotted lines and designated with the reference numeral 16'.

Figure 5D:
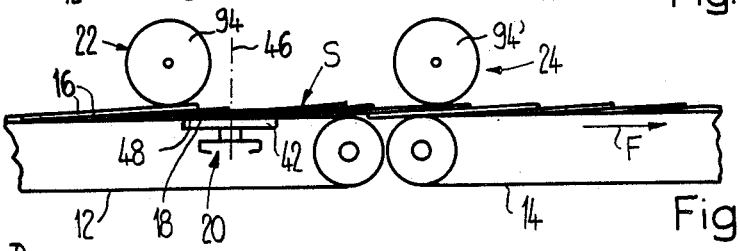

In FIG. 5*d* there is indicated in which manner it is possible that, from an imbricated formation S in which pairwise two printed products 16 are nearly or almost superimposed, there can be formed an imbricated formation S in which the spacing or pitch between the trailing edges 18 of all printed products 16 is evened or made uniform. From the pairwise superimposed printed products 16, the underlying one of the two superimposed printed products 16 is arranged slightly downstream as viewed in the conveying direction F and with respect to the upperlying one of the two superimposed printed products 16. The rotational speed of the cam 48 is synchronized with the conveying speed of the two band or belt conveyors 12 and 14 as well as with the mean or average spacing or pitch of the imbricatingly overlapping pairs of printed products such that the cam 48 comes to bear against the trailing edge 18 of the respective underlying printed product 16 of the two superimposed printed products 16 and accelerate this underlying printed product 16 in the conveying direction F. The retaining or hold-back device 22 retains or holds back the respective overlying printed product 16 against entrainment by the accelerated underlying printed product 16. The pressure roll or roller 94' of the braking or retarding device 24 ensures that the leading or downstream printed product 16 is not entrained.

Figure 6:
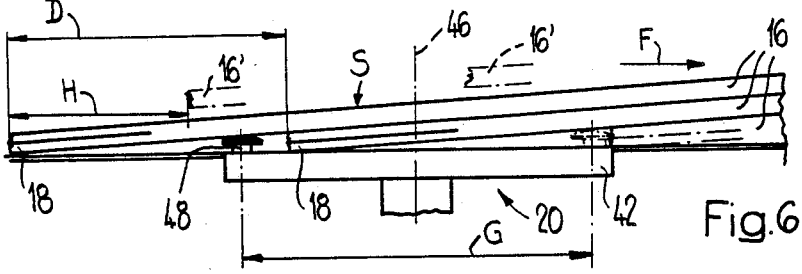
FIG. 6 schematically shows in an enlarged illustration a section or part of the apparatus according to FIG. 1.

In FIG. 6 the substantially mushroom-shaped cam or cam member 48 arranged at the supporting or carrier member 42 is shown in full lines in the rear or upstream end position thereof, and in dash-dotted lines in the forward or downstream end position thereof. The stroke of the cam 48 is designated with the reference character G. The spacing or pitch or distance between the trailing edges 18 of the printed products 16 infed or supplied to the position-change or positioning device 20 is designated by the reference character D. Upon rotation of the supporting or carrier member 42 about the rotational axis 46, the cam 48 comes to bear at the trailing or upstream edge 18 of a respective printed product 16 and further conveys this printed product 16 into the region of the forward or downstream end position indicated in dash-dotted lines.

In FIG. 6 it is particularly clearly shown that the printed products 16 are newspapers which have a leading fold, so that the trailing or upstream edge 16 is formed by the open end or flower of the newspaper. The mushroom shape of the cam 48 prevents a printed product 16 from sliding out of engagement with the cam 48. It is evident that such sliding-out of engagement is also prevented when the newspapers are arranged in the imbricated form with their folds constituting the trailing or upstream edges 18. During each revolution of the supporting or carrier member 42, the imbricated formation S is further conveyed by the spacing or pitch or distance D by means of the conveyors 12 and 14 not illustrated in FIG. 6, so that the cam 48 can act upon a printed product 16 during each revolution or turn. By means of dash-dotted lines there is designated an imbricated formation S in which the spacing or pitch between the trailing edges 18 likewise corresponds with the spacing or distance D. However, this imbricated formation S shown in dash-dotted lines is shifted by the spacing or distance H with respect to the imbricated formation S illustrated in full lines. The spacing or distance H corresponds to a phase shift between the imbricated formation S and the cam 48. This cam 48 catches up with or overtakes the printed product 16' only in the region of the forward or downstream end position indicated by dash-dotted lines. According to the mode of operation illustrated in FIG. 6, it is thus possible to change the position of the printed product 16 in the imbricated formation S in that the imbricated formation S corresponds with the phase relationship predetermined by a station for further processing. In the apparatus according to FIG. 6, the maximum possible phase shift approximately corresponds with the spacing or distance H.

Figure 7A:
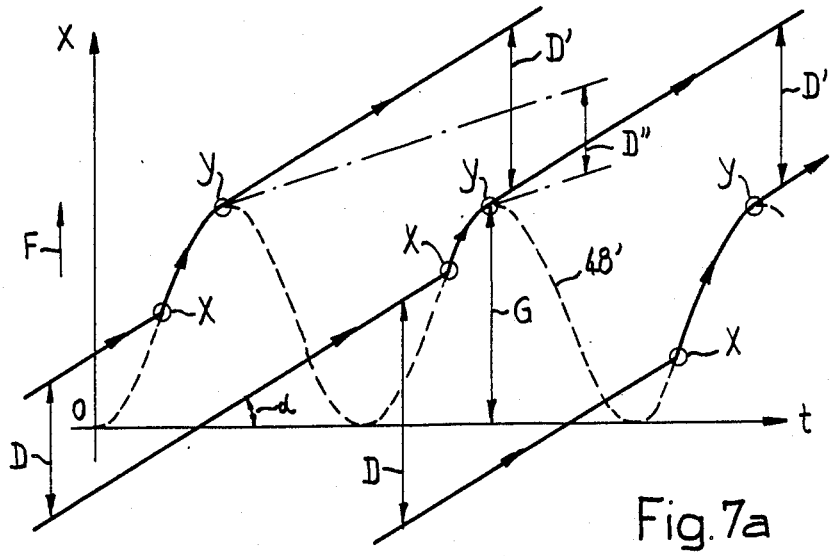
FIG. 7*a* schematically shows a diagram which in a first mode of operation of the apparatus according to FIG. 1 illustrates the position of the printed products as a function of time.
Figure 7B:
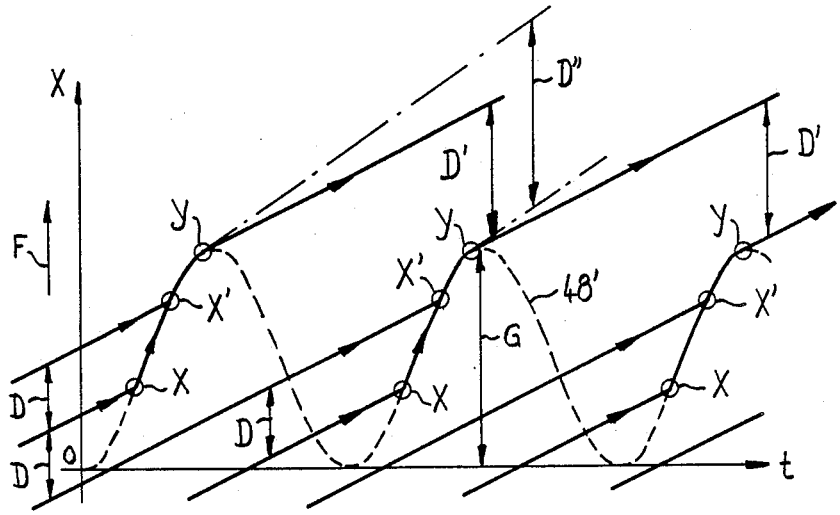
FIG. 7*b* schematically shows a diagram which in a second mode of operation of the apparatus according to FIG. 1 illustrates the position of the printed products as a function of time.

For a better understanding of the mode of operation of the position-change or positioning device (cf. FIGS. 1 through 6), two diagrams are shown in FIGS. 7*a* and 7*b*. These diagrams show the position of the trailing edges 18 in the conveying direction F as a function of time t. The ordinate $x = 0$ corresponds with the rear or upstream end position of the cam 48. At constant speed of the supporting member 42, the movement of the cam 48 with respect to the conveying direction F is sinusoidal and indicated by a broken line designated with the reference numeral 48'. The stroke of the cam 48 is designated with the reference character G. The reference character D designates the spacing or pitch between the trailing edges 18 of the printed products 16 which are infed to the position-change or positioning device 20.

The printed products 16 infed by the first band or belt conveyor 12 at the speed $\alpha$ are overtaken by the cam 48 at the locations designated with the reference character X, and further conveyed in the direction of the ordinate x along the sinusoidal line 48'. At the locations designated with the reference character Y and at which the speed of the cam 48 with respect to the conveying direction F is of the same magnitude as the conveying speed of the second band or belt conveyor 14, the cam 48 releases the trailing edge 18 of the respective engaged printed product 16. The spacing or pitch between the printed products 16 affected or influenced by the position-change or positioning device 20 is essentially constant and designated with the reference character D'. It should be observed that the printed products 16 are delivered with a constant phase relationship relative to the movement of the cam 48. As a result, according to FIG. 5 the spacing or pitch between the printed products 10 in the imbricated formation S is evened and delivered in a predetermined phase relationship.

It is now also possible that the conveying speed of the second band or belt conveyor 14 (cf. FIG. 1) as well as the rotational speed of the endless band or belt 78' of the braking or retarding device 24 is variable by adapting the drive configuration with respect to the conveying speed of the first band or belt conveyor 12. As a result, there is rendered possible the formation of an imbricated formation or stream S in which the spacing or pitch D' can be shortened or lengthened with respect to a mean or average spacing or pitch D between the infed printed products 16. In FIG. 7*a* there is indicated in dash-dotted lines the formation of an imbricated formation or stream S in which the spacing or pitch or distance D' between the printed products 16 is decreased due to a decrease of the conveying speed of the second band or belt conveyor 14.

According to the diagram in FIG. 7*b*, the cam 48 during each rotation or revolution comes to bear at two printed products 16 arranged from one another at a spacing or pitch D and delivers the coincidentally or squared-up and superimposed printed products 16 to the second band or belt conveyor 14. At the locations X in FIG. 7*b*, the cam 48 entrains a printed product 16 and pushes this printed product 16 onto the respective leading printed product 16 and conveys the two superimposed printed products 16 from the locations X' to the locations Y, at which the superimposed printed products 16 are engaged by the second or outfeed band or belt conveyor 14 and thus discharged. The spacing or pitch or distance between the pairs of superimposed printed products 16 is designated with the reference character D'. By increasing the conveying speed of the second band or belt conveyor 14 with respect to the conveying speed of the first band or belt conveyor 12, this spacing or pitch or distance D' can be increased. This is indicated in FIG. 7*b* by dash-dotted lines and illustrated by a double-headed arrow designated with the reference character D''.

In the interest of completeness, reference is made to the fact that by changing the conveying speeds of the two band or belt conveyors 12 and 14, the rotational speed of the disk-shaped supporting or carrier members 42 and the stroke G of the cams 48, a plurality of applications of the inventive apparatus are possible. It is likewise possible to arrange several cams 48 at each respective supporting or carrier member 42. Furthermore, it is also conceivable to control the cams 48 such that they project or protrude into the region of the imbricated formation only at their conveying-active path. It is also possible that the cams 48 are guided in quite a different manner in a closed revolving path, whereby the sections of this closed revolving path, in which the cams 42 act upon the trailing edges 18 of the printed products 16, are arranged in a spaced relationship to one another substantially perpendicular to the conveying direction F. It is thus possible that inclinedly arranged printed products 16 in the imbricated formation are aligned such that the trailing edges 18 thereof extend substantially perpendicular to the conveying direction F. It is also worthy of mention that a single or individual band or belt conveyor, for example, the band or belt conveyor 12, would meet all requirements, provided no imbricated formations S are to be formed in which the spacing or pitch D between the trailing edges 18 have to be increased or decreased.

It is also conceivable that several position-change or positioning devices can be arranged in tandem or succession in order to form imbricated formations S in which three or more printed products 16 are at least almost coincidentally superimposed or squared-up.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. An apparatus for changing the position of printed products such as newspapers, magazines and the like, arranged in an imbricated formation, comprising:

a conveying device defining a plane of conveyance for the imbricated formation;

at least one position-change device provided with a plurality of revolvingly driven entrainment members which pass through at least one closed revolving path;

said conveying device having a predetermined conveying speed and a predetermined conveying direction;

said at least one position-change device having a predetermined rotational speed which is greater than said predetermined conveying speed of said conveying device;

said plurality of revolvingly driven entrainment members acting upon trailing edges of the printed products as viewed in said predetermined conveying direction;

said plurality of entrainment members comprising at least two entrainment members;

said at least one closed revolving path comprising at least two closed revolving paths substantially arranged in said plane of conveyance;

said at least two entrainment members revolving synchronously to one another along said at least two closed revolving paths in order to act in pairs upon the trailing edge of each printed product;

said at least two closed revolving paths having portions in which said at least two entrainment members can be brought to act upon the printed products; and said portions of said at least two closed revolving paths being arranged in spaced relationship in a direction substantially perpendicular to said predetermined conveying direction of said conveying device.

2. The apparatus as defined in claim 1, wherein:
said at least two revolving paths constitute at least two substantially circular paths;
said at least two entrainment members revolving synchronously to one another having predetermined directions of rotation in said at least two substantially circular paths; and
said predetermined directions of rotation in said at least two substantially circular paths being opposite to one another.

3. The apparatus as defined in claim 2, wherein:
the diameter of said at least two substantially circular paths is variable.

4. The apparatus as defined in claim 2, wherein:
said predetermined rotational speed constituting the rotational speed of said at least two entrainment members; and
said rotational speed being variable.

5. The apparatus as defined in claim 4, wherein:
the diameter of said at least two substantially circular paths is variable.

6. The apparatus as defined in claim 1, wherein:
two supporting members define said at least two closed revolving paths;
each of said two supporting members having an axis extending substantially perpendicular to said plane of conveyance;
at least one of said at least two entrainment members being eccentrically arranged at one of said two supporting members;
said two supporting members being arranged in spaced relationship to one another in a direction substantially perpendicular to said direction of conveyance and being rotatably and synchronously driveable about said axes extending substantially perpendicular to said plane of conveyance.

7. The apparatus as defined in claim 6, wherein:
said at least two entrainment members are structured as substantially mushroom-shaped cams.

8. The apparatus as defined in claim 6, wherein:
said two supporting members are structured as disc-shaped elements; and
said at least two entrainment members being displaceably secured at said two supporting members for displacement at least in a radial direction with respect to said axis of the associated supporting member.

9. The apparatus as defined in claim 6, wherein:
said at least two entrainment members are arranged at a predetermined distance from said axes of said two supporting members;
said two supporting members being interchangeable with other supporting members; and
said at least two entrainment members being arranged at said other supporting members at other predetermined distances to said axes of said other supporting members.

10. The apparatus as defined in claim 6, further including:
gearing means providing an operative connection between said two supporting members; and
drive means coupled with one of said two supporting members.

11. The apparatus as defined in claim 10, wherein:
said gearing means comprise two gear wheels meshing with each other and rotatable about said axes of said two supporting members;
said two gear wheels having the same diameter; and
said two supporting members being arranged at said two gear wheels.

12. The apparatus as defined in claim 10, wherein:
said conveying device comprises an endless conveyor having at least two revolvingly driven conveying members arranged in spaced relationship and substantially parallel to one another; and
said drive means coupled with one of said two supporting members being operatively connected to said endless conveyor.

13. The apparatus as defined in claim 6, further including:
gearing means providing an operative connection between said two supporting members; and
drive means coupled with said gearing means.

14. The apparatus as defined in claim 13, wherein:
said gearing means comprise two gear wheels meshing with one another and rotatable about said axes of said two supporting members;
said two gear wheels having the same diameter; and
said two supporting members being arranged at said two gear wheels.

15. The apparatus as defined in claim 13, wherein:
said conveying device comprises an endless conveyor having at least two revolvingly driven conveying members arranged in spaced relationship and substantially parallel to one another; and
said drive means coupled with said gearing means being operatively connected to said endless conveyor.

16. The apparatus as defined in claim 1, wherein:
said conveying device comprises an endless conveyor having at least two revolvingly driven conveying members which are arranged in a spaced relationship and substantially parallel to one another; and
said at least one position-change device being arranged between said at least two revolvingly driven conveying members.

17. The apparatus as defined in claim 16, wherein:
said at least two revolvingly driven conveying members comprise endless bands.

18. The apparatus as defined in claim 16, wherein:
said endless conveyor comprises a conveying-active path having an end region;
said at least one position-change device being arranged in said end region of said conveying-active path of said endless conveyor;
an outfeed device defined by a downstream located one of said two revolvingly driven conveying members; and
said outfeed device having a conveying speed which is variable with respect to a predetermined conveying speed of the other one of the two revolvingly driven conveying members located upstream of said one downstream conveying member.

19. The apparatus as defined in claim 18, further including:
a retaining device arranged upstream of said at least one position-change device; and
said retaining device securing against entrainment a trailing printed product in contact with a leading printed product which is engaged by said at least one position-change device.

20. The apparatus as defined in claim 19, further including:

a braking device arranged downstream of said at least one position-change device; and said braking device serving to brake a printed product released by said position-change device and securing against entrainment a trailing printed product upstream of said released printed product.

21. The apparatus as defined in claim 20, wherein:

said retaining device and said braking device are arranged above said endless conveyor; and said retaining device and said braking device each comprising a revolvingly driveable pressure band.

22. The apparatus as defined in claim 20, wherein:

said retaining device and said braking device are arranged above said endless conveyor; and said retaining device and said braking device each comprising a rotatably mounted driveable pressure roll.

23. The apparatus as defined in claim 1, wherein:

said at least one position-change device constitutes a plurality of position-change devices; and said plurality of position-change devices being arranged in tandem.

24. The use of the apparatus as defined in claim 1 for forming an imbricated formation having an essentially constant imbricated spacing.

25. The use of the apparatus as defined in claim 1 for forming an imbricated formation having a phase relationship predetermined by further product processing.

26. The use of the apparatus as defined in claim 1 for forming an imbricated formation having an essentially constant imbricated spacing and a phase relationship predetermined by further processing.

27. The use of the apparatus as defined in claim 1 for forming an outfed imbricated formation, in which in each case two printed products are at least nearly coincidentally superposed, from an infed imbricated formation in which each printed product imbricatingly overlaps a neighboring printed product and said at least two entrainment members act upon every second printed product of said infed imbricated formation and shifts said every second printed product onto the associated leading product thereof.

28. The use of the apparatus as defined in claim 1 for forming an outfed imbricated formation, in which each printed product imbricatingly overlaps a neighboring printed product, from an imbricated formation in which two almost coincidentally superimposed printed products imbricatingly overlap in pairs two neighboring likewise almost coincidentally superimposed printed products, and said at least two entrainment members each time act upon the lower of the two superimposed printed products and shift in downstream direction said lower printed product with respect to the upper printed product.

* * * * *